US005316451A

United States Patent [19]

Hore, deceased et al.

[11] Patent Number: 5,316,451

[45] Date of Patent: May 31, 1994

[54] VALVE PORTING FOR ROTATING BARREL RAM PUMP

[75] Inventors: Donald G. Hore, deceased, late of Adamstown Heights, by Margaret H. Hore, executor; Norman J. Longworth, Bellevue Hill; David McCarthy, Glen Waverley; Lionel Pullum, Olinda, all of Australia

[73] Assignee: ABB Mineral Slurry Transportation Pty. Ltd., Bondi Junction, Australia

[21] Appl. No.: 960,457

[22] PCT Filed: Jun. 4, 1991

[86] PCT No.: PCT/AU91/00241

§ 371 Date: Feb. 1, 1993

§ 102(e) Date: Feb. 1, 1993

[87] PCT Pub. No.: WO91/19094

PCT Pub. Date: Dec. 12, 1991

[30] Foreign Application Priority Data

Jun. 5, 1990 [AU] Australia ..... PK0485

[51] Int. Cl.[5] ..... F04B 1/20

[52] U.S. Cl. ..... 417/392; 417/457; 91/485

[58] Field of Search ..... 417/269, 271, 272, 392, 417/449, 457, 460, 461; 91/472, 499, 501, 485

[56] References Cited

U.S. PATENT DOCUMENTS

| | | | |
|---|---|---|---|
| 2,388,644 | 11/1945 | Roessler | 91/485 |
| 3,228,303 | 1/1966 | Budzich | 91/485 |
| 4,401,415 | 8/1983 | Hammelmann | 417/457 |

FOREIGN PATENT DOCUMENTS

| | | |
|---|---|---|
| 461204 | 5/1975 | Australia . |
| 0249175 | 12/1987 | European Pat. Off. . |
| 1388775 | 3/1975 | United Kingdom . |

*Primary Examiner*—Richard A. Bertsch
*Assistant Examiner*—Alfred Basichas
*Attorney, Agent, or Firm*—Daniel H. Bliss

[57] ABSTRACT

A positive displacement pump for slurry incorporating particulate solids in suspension to provide an initial inlet port opening clearance corresponding to the exposed area of overlap between the port and each corresponding cylinder opening sufficient to permit substantially uninterrupted passage of particulate solids at the commencement of each suction cycle, the cylinder openings and following the initial overlap the total cross-sectional flow area exposed to each of the ports is generally constant irrespective of the rotational position of the barrel within the housing such that a constant volummetric flow rate of the driving fluid tends to effect a corresponding substantially constant volummetric flow rate of the fluid to be pumped.

14 Claims, 6 Drawing Sheets

VALVE PORTING FOR ROTATING BARREL RAM PUMP

FIELD OF THE INVENTION

The present invention relates to hydraulic pumps and motors.

The invention has been developed primarily for pumping suspensions of particulate solids in slurry form for pipeline transportation and will be described hereinafter with reference to this application. However, it will be appreciated that the invention is not limited to this particular field of use.

BACKGROUND OF THE INVENTION

The costs associated with transportation of important minerals such as coal often comprise a substantial proportion of the total costs of material handling. Conventional transportation systems such as belt conveyors, road and rail are generally inefficient and make considerable demands on space and resources. In many circumstances, transportation costs are often higher than the actual mining costs and usually represent the principal cost at the point of consumption.

As an alternative to these conventional methods, attempts have been made to transport minerals in suspension in slurry form along a pipeline. However, such slurry systems have not generally gained acceptance as a commercially viable means of mineral transportation, largely due to a lack of development in a number of associated areas of technology. In particular, it has been found that pump pulsations, inadequate valve performance in handling larger particles, problems associated with slurry preparation, and inadequate theoretical understanding of the dynamic behavioural characteristics of the slurry have resulted in slurry transportation systems not yielding the economic motivation for widespread commercialisation.

In an attempt to ameliorate these problems, a so called rotary ram pump was developed and this is described in detail in Australian patent specification 461204. The object of that invention was to provide the advantages of a positive displacement pump while at the same time attempting to provide substantially uniform delivery characteristics. However, in practice this pump has been found to be inadequate in several respects.

It has been found that a major problem with the known rotary ram pumps is the tendency for larger particles to block the partially open ports on the suction side of the pump during the initial inlet stage of the suction cycle. This problem is particularly significant when pumping coarse (dense phase) coal slurry due to the presence of relatively large size coal particles. Once the ports become even partially blocked, the smooth fluid flow through the pump is disrupted thereby sending sharp pressure pulses down the pipe line and significantly reducing the effective suction pressure. It has been found through extensive research and development that even minor disturbances of this nature can cause transient instabilities in the sensitive slurry bed which in turn can result in blockages in the hydraulic transport line where pulseless conditions must be maintained within relatively narrow limits in order to permit efficient and smooth pumping of the slurry. This problem is further exacerbated when eratic dynamic behaviour of the pump resulting from partial port blockages causes the free-floating pistons to collide with their respective end stops. This sends relatively severe shock pulses down the hydraulic transport line, further destabilising the vibration sensitive slurry bed and resulting in line blockages which often need to be manually cleared.

In addition, it has been found that the partial port blockages of the type discussed can create a filtration effect, preferentially allowing the passage of finer particles, whilst substantially impending the movement of relatively coarse particles through the pump. This tends to exacerbate the intial blockage, and can eventually form a "plug" in the port, substantially impairing the efficient performance and operation of the pump. Moreover, this disturbs the uniformity of particle size distribution, which has found to be essential for pumping slurries over longer distances.

It is therefore an object of the present invention to provide an improved pump which overcomes or substantially ameliorates at least some of these disadvantages of the prior art.

DISCLOSURE OF THE INVENTION

Accordingly, the present invention provides a positive displacement pump for slurry incorporating particulate solids in suspension, said pump including:

a housing;

a barrel rotatably mounted within the housing and including a plurality of peripherally spaced motor cylinders and a corresponding number of pump cylinders in respective coaxial alignment with said motor cylinders forming a peripheral array of generally longitudinally extending spaced apart motor and pump cylinder pairs;

a plurality of double acting piston assemblies each comprising a first piston disposed within a respective motor cylinder and a second piston interconnected with and spaced apart from said first piston and disposed within a corresponding pump cylinder, said piston assemblies being sealingly and slideably mounted for reciprocation within the respective motor and pump cylinder pairs;

interconnecting means associated with said motor and pump cylinder pairs whereby axial displacement of any one of said piston assemblies effects a corresponding axial displacement of another of said piston assemblies in predetermined phase relationship;

a stationary motor port block fixed with respect to said housing and including a driving fluid supply port and a driving fluid exhaust port disposed respectively to overlap periodically with corresponding openings in said motor cylinders whereby driving fluid under pressure is alternately admitted into successive motor cylinders through said supply port and discharged through said exhaust port in response to rotational movement of said barrel within said housing thereby to effect a corresponding phase related reciprocating movement of said piston assemblies;

a stationary pump port block fixed with respect to said housing and including an inlet port and a discharge port disposed respectively to overlap periodically with corresponding openings in said pump cylinders whereby fluid to be pumped is alternately admitted into successive pump cylinders through said inlet port as the respective piston assemblies are withdrawn during a suction cycle, and subsequently discharged under pressure through said discharge port as the respective pistons are advanced during a pumping cycle in response to the rotational movement of the barrel;

said inlet port being configured so as to initially overlap with each corresponding opening in said pump cylinders before the respective pistons associated with those cylinders begin to withdraw, thereby to provide an initial inlet port opening clearance corresponding to the exposed area of overlap between said port and each said corresponding cylinder opening sufficient to permit substantially uninterrupted passage of said particulate solids at the commencement of each said suction cycle;

said cylinder openings and said ports being disposed such that following said initial overlap the total cross sectional flow area exposed to each of said ports is generally constant irrespective of the rotational position of said barrel within said housing such that a constant volumetric flow rate of said driving fluid tends to effect a corresponding substantially constant volumetric flow rate of said fluid to be pumped.

The initial inlet port opening clearance preferably defines a cross sectional flow area having a minimum dimension greater than the maximum expected size of the particulate solids in suspension. However, substantial benefits are also obtained where the size of the initial opening clearance corresponds to the "D-50" of the particulate material. That is to say, where the initial clearance is sufficient to permit the passage of 50% of the incident particulate mass.

In a preferred embodiment, the discharge port is also shaped so as to initially overlap with the corresponding openings in the pump cylinders before the respective pistons associated with those cylinders begin to advance, thereby to provide an initial discharge port opening clearance sufficient to permit substantially uninterrupted passage of the particulate solids at the commencement of each pumping cycle.

Preferably also, the inlet port is generally in the shape of an annular sector having radially spaced circumferentially extending arcuate longitudinal edges and an outwardly protruding generally arcuate leading edge defining a corresponding edge of said opening clearance between the inlet port and each corresponding cylinder opening.

Preferably, the peripherally spaced apart motor and pump cylinder pairs are substantially parallel to the rotational axis of the barrel.

Preferably also, the interconnecting means comprises a plurality of independent hydraulic fluid circuits connecting central regions of respective diametrically opposed motor and pump cylinder pairs bounded by corresponding first and second pistons of respective piston assemblies whereby axial displacement of any one of the piston assemblies effects a corresponding axial displacement of the respective diametrically opposed piston assembly in the opposite direction. In this configuration, the hydraulic circuits act in a way analogous to mechanical rockers whereby diametrically opposed piston assemblies move 180° out of phase.

Preferably, the pump includes four peripherally spaced motor and pump cylinder pairs, each connected to a diametrically opposed pair by means of an independent hydraulic fluid circuit.

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 1:
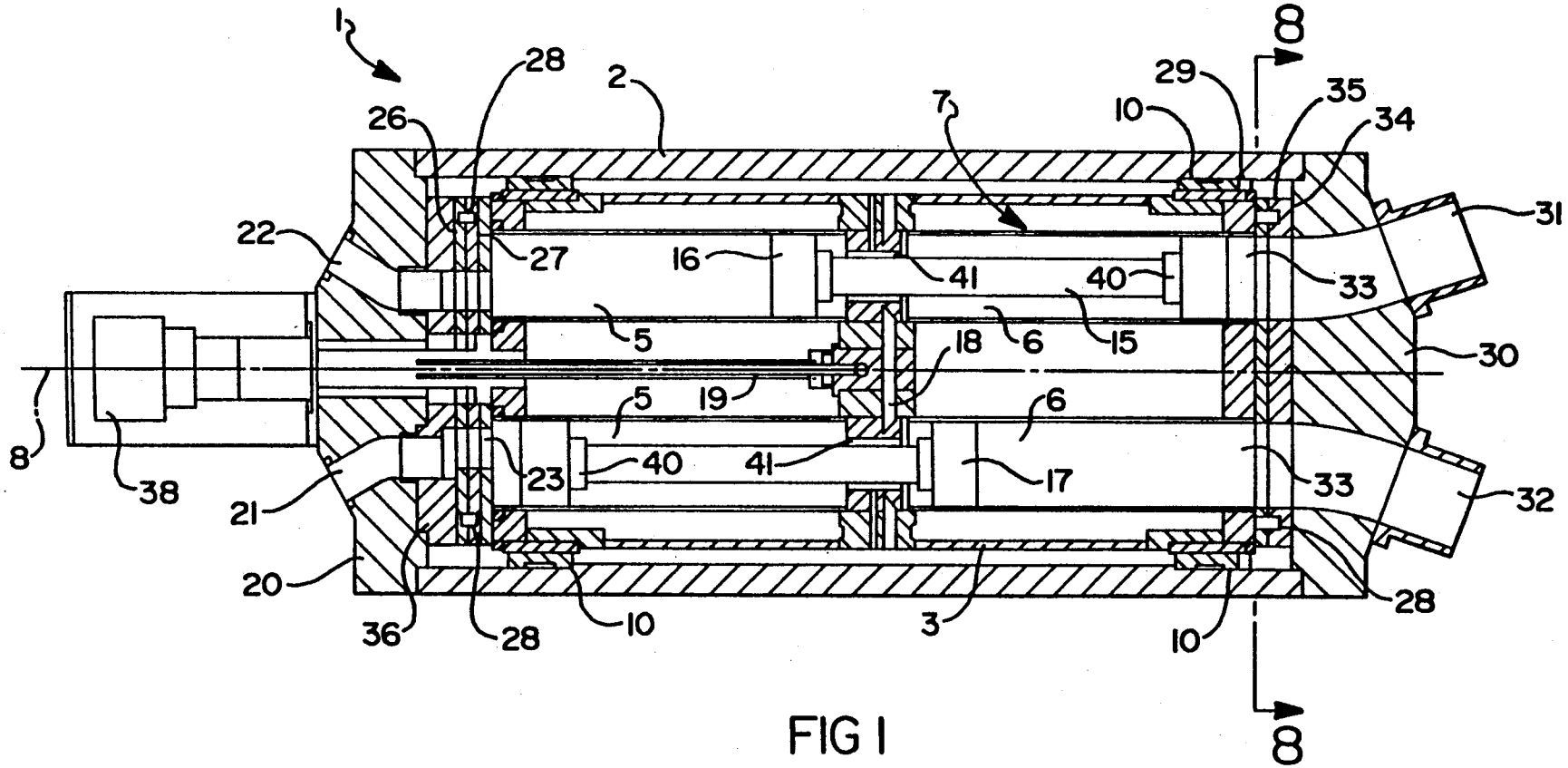
FIG. 1 is a cut-away sectional plan view showing a positive displacement pump according to the invention.

Referring generally to the drawings, wherein corresponding features are denoted by corresponding reference numerals, a positive displacement pump 1 includes a generally cylindrical housing 2 and a cylindrical barrel 3 rotatably mounted within the housing. Barrel 3 includes four uniformly peripherally spaced motor cylinders 5 and four corresponding pump cylinders 6 in respective coaxial alignment with the motor cylinders. Motor cylinders 5 and corresponding pump cylinders 6 together form a peripheral array of uniformly circumferentially spaced apart motor and pump cylinder pairs 7 parallel to the rotational axis 8 of the barrel. The barrel is rotatably supported within the housing by means of axially spaced apart hydrostatic radial bearings 10 supplied with water under pressure from a supply source through respective orifices 11 to provide relatively frictionless rotation and a continuous flushing action which minimises wear by transporting any abrasive particles in suspension away from the bearings. Leakage flow is drained from the housing through drainage pipe 12.

The pump further includes four double-acting piston assemblies 15, each comprising a first piston 16 disposed within a respective motor cylinder 5 and a second piston 17 interconnected with, and spaced apart from, the first piston 16 and disposed within a corresponding pump cylinder 6. The piston assemblies 15 are sealingly and slideably mounted for reciprocation within their respective cylinders.

Figure 2:
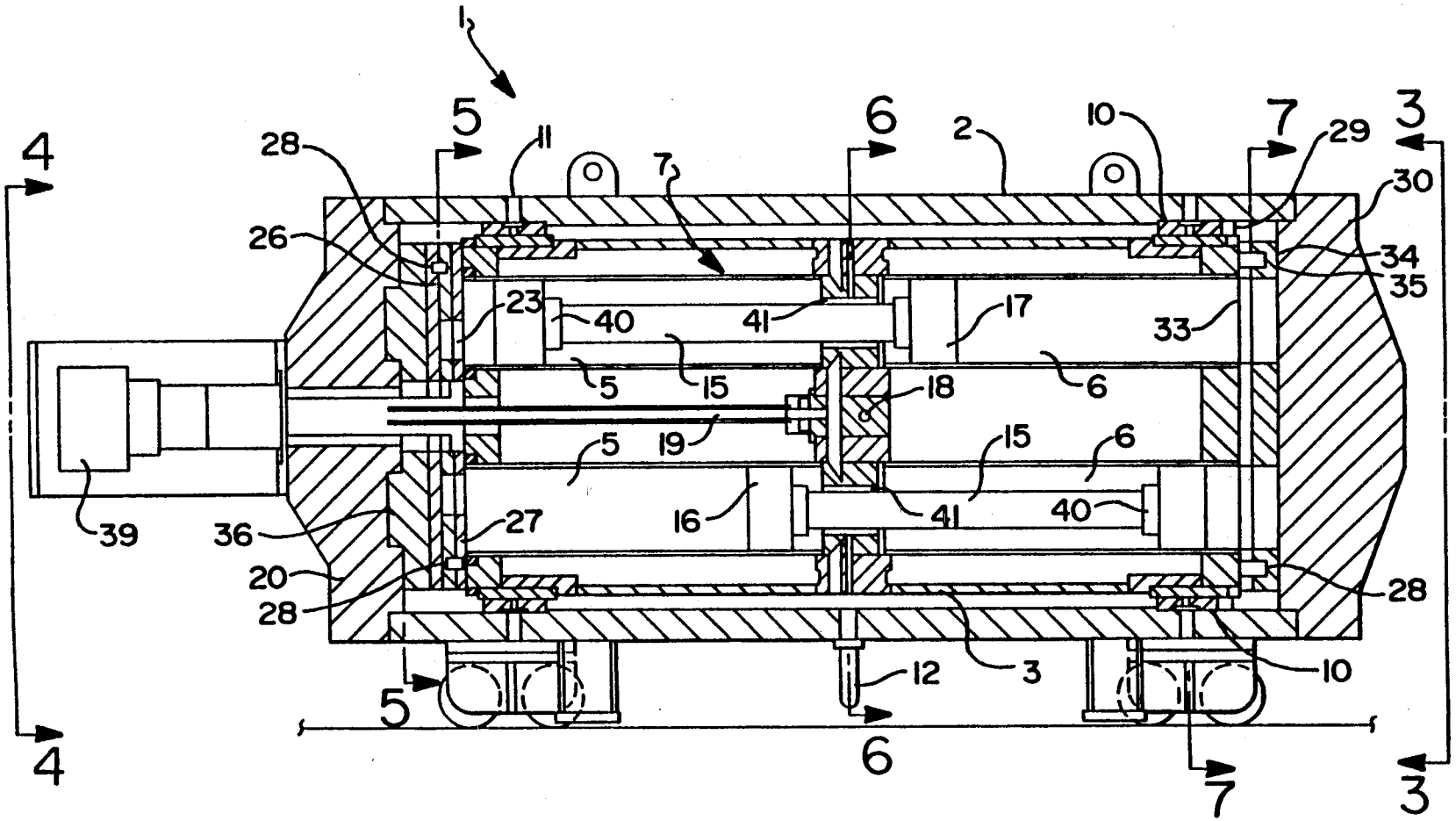
FIG. 2 is a cut-away cross sectional side elevation showing the pump of FIG. 1.
Figure 3:
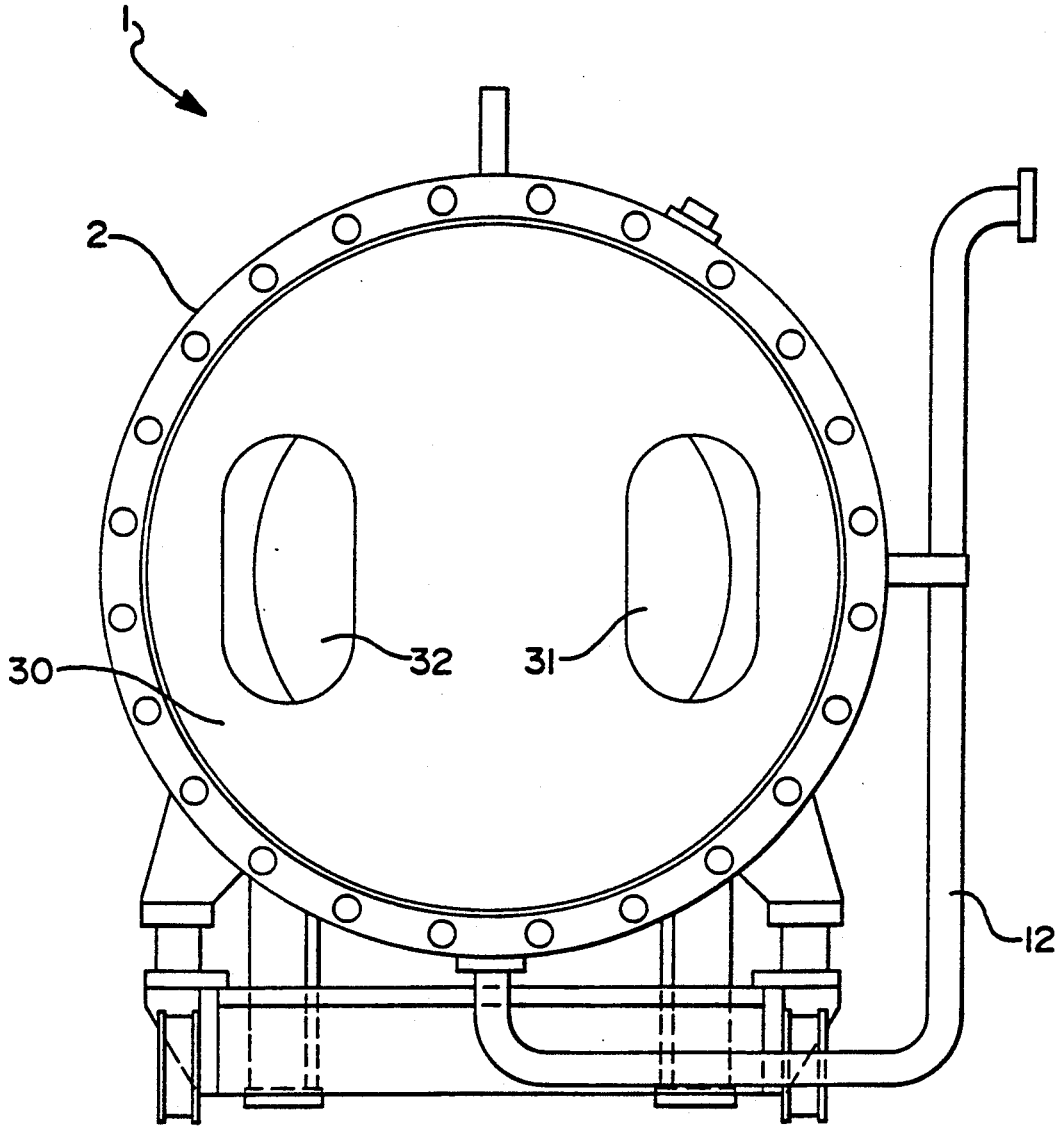
FIG. 3 is an end view taken along line 3—3 of FIG. 2.
Figure 5:
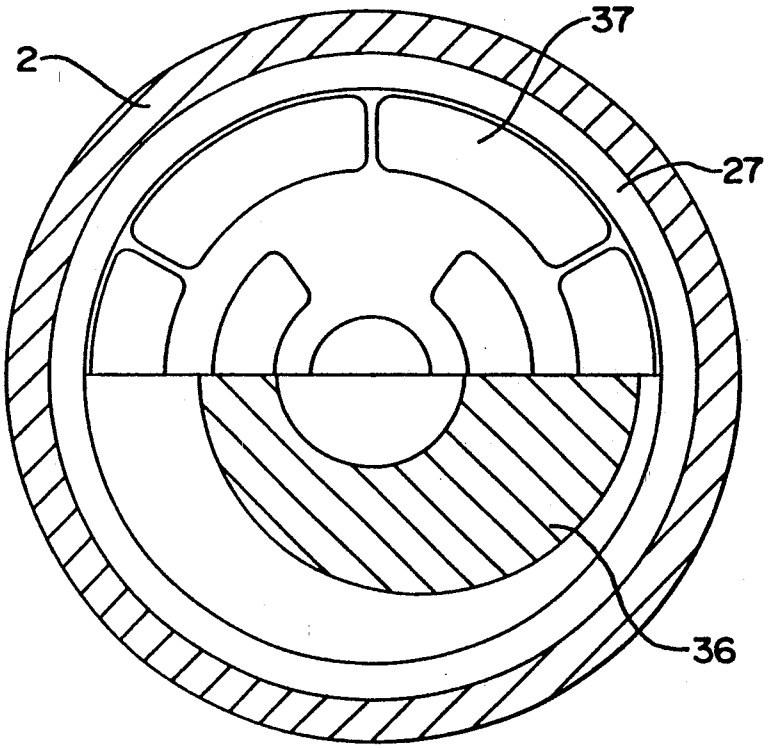
FIG. 5 is a sectional view taken along line 5—5 of FIG. 2.
Figure 4:
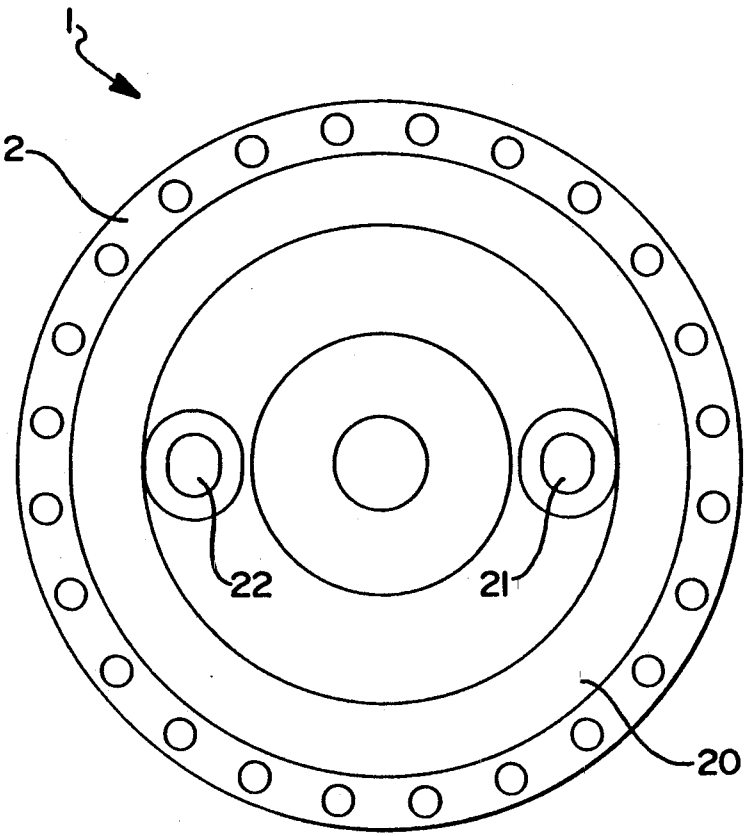
FIG. 4 is an opposite end view taken along line 4—4 of FIG. 2.
Figure 7:
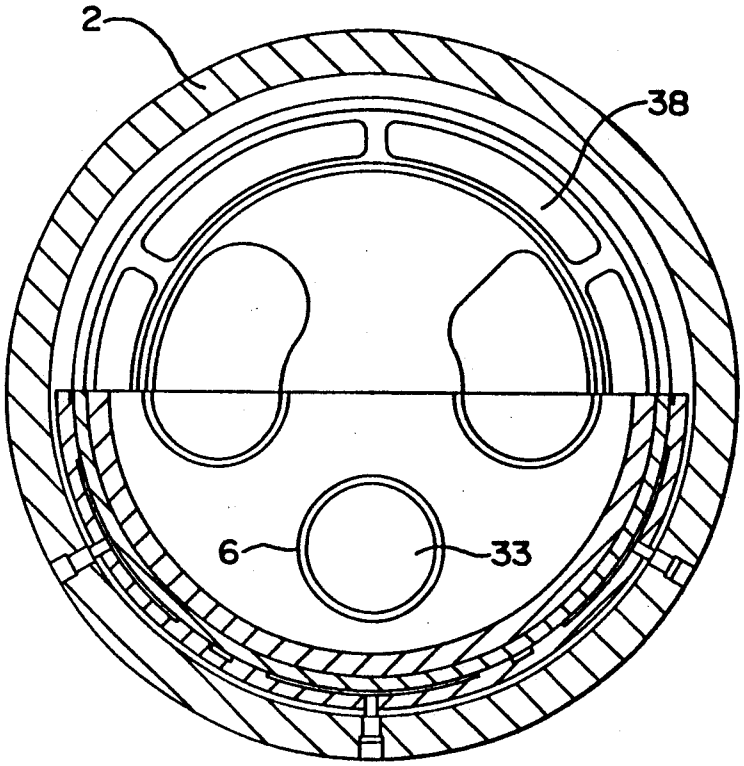
FIG. 7 is a sectional view taken along line 7—7 of FIG. 2.
Figure 6:
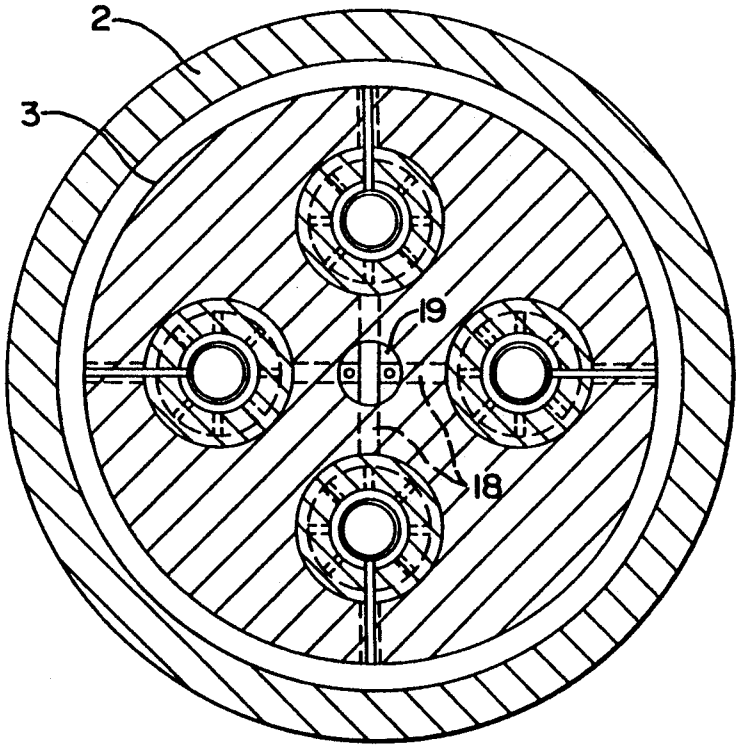
FIG. 6 is a sectional view taken along line 6—6 of FIG. 2 showing the hydraulic circuits interconnecting diametrically opposed motor and pump cylinder pairs.

Diametrically opposed cylinder pairs 7 are interconnected by respective independent hydraulic fluid circuits 18. As best seen in FIGS. 1 and 2, hydraulic circuits 18 connect regions of opposed cylinder pairs 7 bounded by corresponding first and second pistons 16 and 17 of respective piston assemblies 15 whereby axial displacement of any one of the piston assemblies effects a corresponding displacement of the diametrically opposed piston assembly in the opposite direction. In this way, it will be seen that the interconnecting hydraulic circuits act conceptually as independent mechanical rockers providing a driving connection between diametrically opposed piston assemblies. It will be appreciated, however, that opposed pistons need not move exactly 180° out of phase as in the preferred embodiment, but can be arranged to move in any predetermined phase relationship depending upon the particular number and configuration of pistons used. Leakage flow from circuits 18 is drained from the housing through drainage line 12 and made up through central supply passage 19 from an independent high pressure water supply.

The motor end of the pump (the left hand end when viewing the drawings) includes a stationary motor port block 20 fixed with respect to the housing and comprising a driving fluid supply port 21 and a corresponding spaced apart driving fluid exhaust port 22 disposed respectively to overlap periodically with corresponding openings 23 in the proximate ends of the motor cylinders. Water under pressure is alternately admitted into successive motor cylinders 5 through supply port 21 and subsequently discharged through exhaust port 22 in response to rotational movement of the barrel within the housing to effect a corresponding phase related reciprocating movement of piston assemblies 15 within respective motor and pump cylinder pairs 7 in a manner to be described more fully below Stationary wear plate 26 and opposed rotating wear plates 27 associated respectively with port block 20 and barrel 3 accommodate wear between the valve faces and are periodically replaced as valve clearances exceed acceptable upper limits.

Similarly, a stationary pump port block 30 is disposed at the opposite end of the housing (the right hand end when viewing the drawings). The pump port block 30 includes slurry inlet port 31 and corresponding spaced apart discharge port 32 disposed respectively to overlap periodically with corresponding openings 33 in the proximate ends of pump cylinders 6. Slurry to be pumped is alternately drawn into successive pump cylinders through inlet or suction port 31 and subsequently forced under pressure through discharge port 32 in response to the reciprocating movement of the piston assemblies and corresponding phase related rotational movement of the barrel. Once again, stationary wear plate 34 and rotating wear plate 35 associated respectively with port block 30 and barrel 3 accommodate wear between adjacent valve faces and are periodically replaced as required to maintain valve leakage flow to within predetermined acceptable limits.

Complementary peripheral seals 28 are disposed at either end of the pump intermediate respective opposed valve surfaces to minimise leakage flow. This is particularly important at the discharge end of the pump to minimise leakage of the fine coal fraction which, apart from representing a commercially significant proportion of the overall coal volume, is essential to maintain the critical rheological properties of the slurry within the narrow band necessary for efficient pumping. Circumferential bearing water seals 29 isolate the water associated with the hydrostatic radial bearings form any slurry leakage.

An eccentric floating thrust block 36 is slideably interposed between port block 20 and barrel 3 and acts in conjunction with peripheral seals 28 and hydrostatic thrust bearing pockets 37 and 38 associated respectively with the motor and pump ends of the barrel to provide a self-adjusting hydrostatic thrust bearing system which automatically reduces the axial thrust pressure on the barrel when the valve clearances increase and increases the thrust pressure when the respective clearances begin to close. This action automatically maintains the critical working clearances between adjacent valve faces at either end of the pump to within a precise tolerance range substantially narrower than can be achieved using conventional mechanical adjustment techniques, thereby significantly reducing valve leakage and associated problems.

The cylinder openings 23 and 33, and respective motor and pump ports 21, 22 and 31, 32 are disposed such that the total cross sectional flow area exposed to each of the ports is substantially constant, irrespective of the rotational position of the barrel within the housing such that a constant volumetric flow rate of the driving fluid through the motor tends to effect a corresponding generally constant volumetric flow rate of slurry at the outlet of the pump.

Turning now to describe the operation of the pump in more detail, the barrel is first connected to a suitable rotary prime mover such as an electric or hydraulic motor (not shown) by means of input drive shaft 39. The optimum rotational speed of the barrel will be dependent upon a number of parameters including those described in Australian patent specification 461204 and will typically be of the order of 40 revolutions per minute. Motor supply port 21 is connected to a suitable high pressure water supply (also not shown) and exhaust port 22 preferably connected to the low pressure side of that supply for recirculation. A "make-up" volume will also be required to accommodate any leakage flow. Similarly, inlet or suction port 31 is connected to a supply of slurry and discharge port 32 connected to the pipeline along which the slurry is to be pumped.

Rotation of the barrel by the prime mover brings successive motor cylinder openings 23 into alignment with supply port 21 whereupon corresponding piston assemblies 15 are successively driven to the right (when viewing the drawings) by means of the high pressure water introduced into the motor cylinders. Simultaneously, this causes slurry within the corresponding pump cylinders to be discharged under pressure through discharge port 32 during each pumping cycle. The motor cylinders are larger in diameter than the corresponding pump cylinders to provide a proportionately greater driving force on the motor and of the piston assemblies to ensure that the pump is able to overcome fluid back pressure in the slurry discharge line.

As each piston assembly moves to the right under the action of the higher pressure driving fluid, water contained in the region bounded by the first and second pistons 16 and 17 is forced through respective hydraulic circuit 18 into the corresponding region of the diametrically opposed cylinder pair thereby to effect a corresponding reciprocating movement of the opposed piston assembly in the opposite direction. This in turn causes slurry to be drawn into that pump cylinder through inlet port 31 as the piston is withdrawn during each suction cycle and subsequently discharged through port 32 during the corresponding pumping cycle as described above. In this way, as each piston assembly is driven to the right by the high pressure driving fluid, the diametrically opposed piston is driven to the left so that as slurry is successively discharged from each pump cylinder, it is simultaneously drawn into an opposing pump cylinder on the suction side such that a constant volumetric flow rate of the driving fluid tends to effect a corresponding generally constant volumetric flow rate of the slurry to be pumped.

However, while the known rotary ram pump described in Australian patent specification 461204 was found to work adequately in this respect when pumping water or other homogeneous liquids, it was found to be inadequate for pumping non-homogeneous mixtures such as coarse particle dense phase slurries over longer distances. As a result of extensive research and development, it has been found that there is a tendency for the coarser particles of the slurry to block the partially open static inlet port during the initial stage of the suction cycle. Even if the blockage is only partial or transient, it has been found that at the critical opening stage of the inlet port this is sufficient to disrupt the smooth flow of fluid through the pump which in turn causes pressure pulses to proceed down the pipe line. Unexpectively, it has now been found through extensive rheological experimentation that even minimal vibrational disturbances of this nature can be sufficient to cause the fast surface flow of relatively dilute liquor within the hydraulic transport line to destabilise the relatively slow moving more dense underlying slurry bed. This in turn can cause blockages in the sensitive hydraulic transportation line where it has now been found that critical pulseless conditions must be maintained in order to ensure efficient and smooth pumping of the particulate slurry over longer distances. Moreover, as discussed above, partial port blockages can create a "filter" tending to plug the port and/or disturb the uniformity of particle size distribution, which has been found to be critical for efficient pumping, particularly in the case of relatively coarse dense phase slurries.

Figure 9:
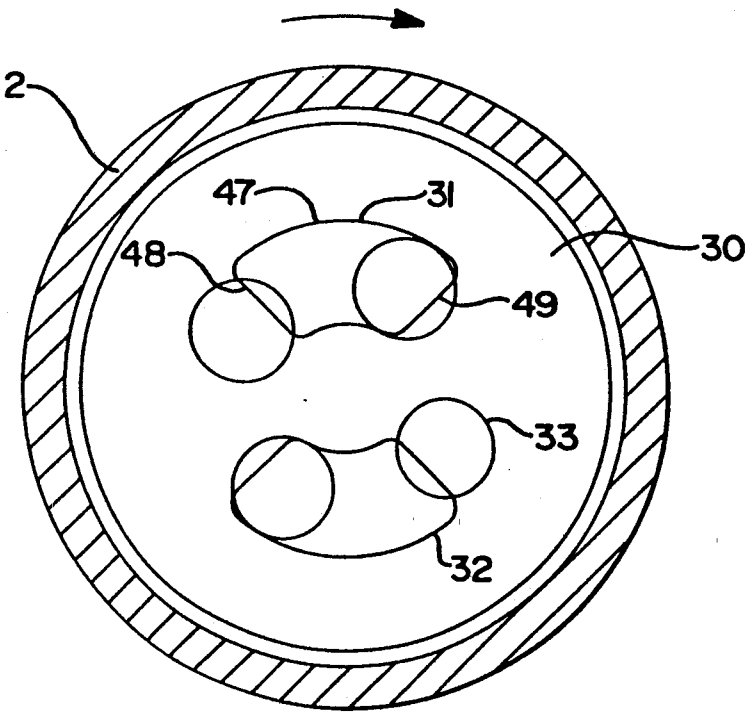
FIG 9 PRIOR ART
FIG. 9 is a sectional view similar to FIG. 8 but showing the known inlet port configuration of the prior art.
Figure 8:
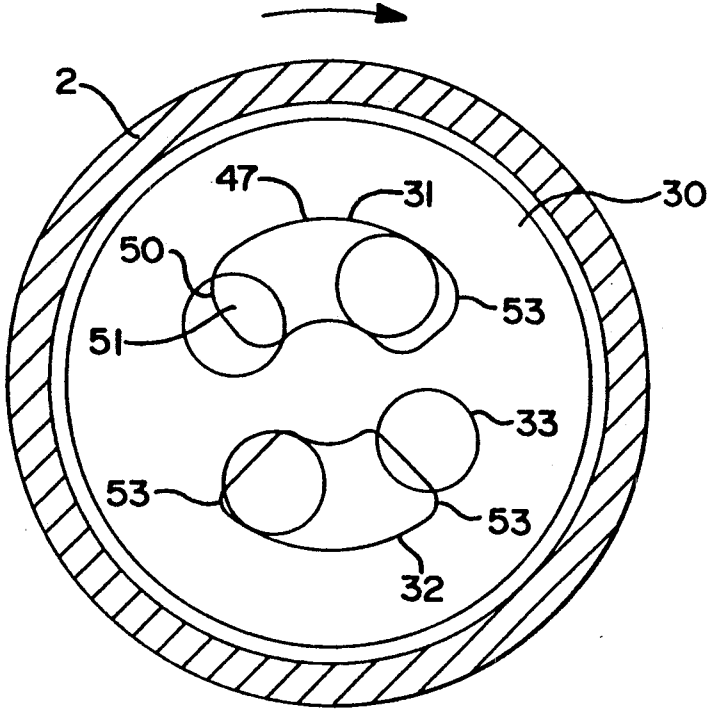
FIG. 8 is a sectional view taken along line 8—8 of FIG. 1 showing diametrically the shape and configuration of the slurry inlet port of the pump according to the present invention.

Flowing from these surprising realisations, the pump according to the present invention includes a specially shaped inlet port 31 as best seen in FIG. 8 and as best understood with comparative reference to the corresponding known port configuration of the prior art as shown in FIG. 9, wherein corresponding features are denoted by corresponding reference numerals. In both cases, the inlet ports 31 have a generally annular segmental configuration defined circumferentially by radially spaced arcuate longitudinal edges 47. However, it will be seen from a close inspection of FIG. 8 that the inlet port of the prior art is defined by substantially straight leading 48 and trailing 49 radial edges. In contrast, the inlet port 31 of the present invention as shown in FIG. 8 is defined by an outwardly and forwardly protruding generally arcuate leading edge 50.

The inlet port and in particularly the leading edge 50 according to the present invention is thus shaped so as to initially overlap with each successive corresponding opening 33 in the proximate ends of the respective pump cylinders 6 before the pistons associated with those cylinders actually begin to retreat and thereby draw slurry into the respective pump cylinders. This configuration thereby provides an initial inlet port opening clearance 51, corresponding to the initial exposed area of overlap between the inlet port and each cylinder opening, sufficient to permit the uninterrupted passage of the larger particulate solids suspended in the slurry at the commencement of each suction cycle. In this way, a lead time is provided before the interconnected controlling piston begins to move such that the suction cycle is not actually commenced until the inlet port is already open sufficiently to allow the majority of larger particles to pass freely through the port. It will be appreciated that the discharge port can also be configured in this way.

This arrangement has been found to largely overcome the problem of partial port blockages during the initial opening stages of the inlet port and consequently overcomes the associated problem of vibrational destabilisation of the sensitive slurry bed. It will be apparent that this helps significantly to prevent blockages in the hydraulic transport line by ensuring that the stable pressure conditions of the slurry bed are maintained within the critical relatively narrow band required for efficient pumpability. In addition, recent testing has shown that the improved port timing the subject of the present invention is of enormous benefit to the suction performance of the pump, particularly in connection with ultra high concentrated slurries and pastes. Thus, the present invention represents a commercially significant improvement over the prior art.

It has also been found that increasing the corner radii 53 of the inlet and discharge ports (as best seen in FIG. 8) tends to minimise the formation of a circumferential roll groove which otherwise tends to wear into the opposing pump valve faces and short circuit the valve system.

It is preferable for efficient operation of the pump that the hydraulic pressures and barrel speed are designed in such a way that the pistons approach the limits of maximum excursion in both directions, without actually abutting their respective end stops. However, any transient pressure instabilisation or fluctuations in the system arising from port blockages or otherwise can permit the free-floating pistons to behave erratically and collide with their end stops. This also induces severe pressure waves in the pipe line which can destabilise the slurry bed and produce clogging as discussed above. It is therefore often necessary in practice to run the pump at significantly less than optimum efficiency in an attempt to avoid the possibility of transient shock vibrations caused by erratic pump performance.

In order to ameliorate this problem and thereby permit more efficient operation of the pump, each piston includes a stepped cylindrical shoulder portion 40 nestably engageable with a corresponding frusto-conical tapered end socket 41 to provide a degree of hydraulic piston damping. As the pistons approach the extreme limits of their maximum axial excursion, stepped shoulders 40 begin to nestably engage respective tapered sockets 41 thereby defining a progressively reducing annular cross-sectional flow area. As the shoulder proceeds into the socket, the opposing damping force increases progressively as a function of reducing flow area in accordance with the principles of thin passage rheology to damp the collision of the pistons with their respective end stops and thereby prevent undesirable shock vibrations. This aspect of the invention thus acts in conjunction with the improved porting to minimise vibration and thereby greatly facilitate the hydraulic pipeline transport of coarse phase slurries.

The pump further includes a pressure monitoring system comprising pressure transducers (not shown) to monitor pressure flunctuations within the pump and position transducers (also not shown) to monitor the position of the pistons within their respective cylinders. These transducers form part of a feedback control system which can be set up to automatically adjust the pump speed in response to vibration levels exceeding predetermined acceptable limits to prevent erratic pump performance and the possibility of consequential line blockages and damage to the pump whilst permitting the pump to operate at close to maximum efficiency. In addition, the position transducers of the positive displacement pistons can be used to provide useful and accurate information on important operating parameters such as instantaneous flow rate, volumetric efficiency, piston speed and the like.

Although this invention has been described with reference to specific examples, it will be appreciated by those skilled in the art that the invention may be embodies in many other forms. For example, the motor and pump cylinder pairs need not be parallel to the rotational axis of the barrel, but could be splayed so as to diverge radially outwardly in a frusto-conical array.

Furthermore, the initial inlet port overlap clearance need not be defined directly by the protruding leading edge of the inlet port, but could also be provided by the shape, configuration, or disposition of the pump cylinder openings, the relationship between the interconnected piston assemblies, the relationship between the pump and motor ports, or other valve timing means.

We claim:

1. A positive displacement pump for slurry incorporating particulate solids in suspension, said pump including:

a housing;

a barrel rotatably mounted within the housing and including a plurality of peripherally spaced motor cylinders and a corresponding number of pump cylinders in respective coaxial alignment with said motor cylinders forming a peripheral array of generally longitudinally extending spaced apart motor and pump cylinder pairs;

a plurality of double acting piston assemblies each comprising a first piston disposed within a respective motor cylinder and a second piston interconnected with and spaced apart from said first piston and disposed within a corresponding pump cylinder, said piston assemblies being sealingly and slideably mounted for reciprocation within the respective motor and pump cylinder pairs;

interconnecting means associated with said motor and pump cylinder pairs whereby axial displacement of any one of said piston assemblies effects a corresponding axial displacement of another of said piston assemblies in predetermined phase relationship;

a stationary motor port block fixed with respect to said housing and including a driving fluid supply port and a driving fluid exhaust port disposed respectively to overlap periodically with corresponding openings in said motor cylinders whereby driving fluid under pressure is alternately admitted into successive motor cylinders through said supply port and discharged through said exhaust port in response to rotational movement of said barrel within said housing thereby to effect a corresponding phase related reciprocating movement of said piston assemblies;

a stationary pump port block fixed with respect to said housing and including an inlet port and a discharge port disposed respectively to overlap periodically with corresponding openings in said pump cylinders whereby fluid to be pumped is alternately admitted into successive pump cylinders through said inlet port as the respective piston assemblies are withdrawn during a suction cycle, and subsequently discharged under pressure through said discharge port as the respective pistons are advanced during a pumping cycle in response to the rotational movement of the barrel;

said inlet port being configured so as to initially overlap with each corresponding opening in said pump cylinders before the respective pistons associated with those cylinders begin to withdraw, thereby to provide an initial inlet port opening clearance corresponding to the exposed area of overlap between said port and each said corresponding cylinder opening sufficient to permit substantially uninterrupted passage of said particulate solids at the commencement of each said suction cycle;

said cylinder openings and said ports being disposed such that following said initial overlap the total cross sectional flow area exposed to each of said ports is generally constant irrespective of the rotational position of said barrel within said housing such that a constant volumetric flow rate of said driving fluid tends to effect a corresponding substantially constant volumetric flow rate of said fluid to be pumped.

2. A pump according to claim 1 wherein the initial inlet port opening clearance defines a cross sectional flow area having a minimum dimension greater than the D-50 size of the particulate solids in suspension.

3. A pump according to claim 1 wherein the initial inlet port opening clearance defines a cross sectional flow area having a minimum dimension greater than the maximum expected size of the particulate solids in suspension.

4. A pump according to claim 1 wherein the discharge port is also shaped so as to initially overlap with the corresponding openings in the pump cylinders before the respective pistons associated with those cylinders begin to advance, thereby to provide an initial discharge port opening clearance sufficient to permit substantially uninterrupted passage of the particular solids at the commencement of each pumping cycle.

5. A pump according to claim 4 wherein the initial discharge port opening clearance defines a cross sectional flow area having a minimum dimension greater than the D-50 size of the particulate solids in suspension.

6. A pump according to claim 4 wherein the initial discharge port opening clearance defines a cross sectional flow area having a minimum dimension greater than the maximum expected size of the particulate solids in suspension.

7. A pump according to claim 1 wherein said inlet port is generally in the form of an annular sector having radially spaced substantially arcuate longitudinal edges and an outwardly protruding generally arcuate leading edge extending therebetween to define a corresponding edge of said opening clearance between the inlet port and each corresponding cylinder opening.

8. A pump according to claim 1 wherein the peripherally spaced motor and pump cylinder pairs are substantially parallel to the rotational axis of the barrel.

9. A pump according to claim 1 wherein said interconnecting means comprises a plurality of independent hydraulic fluid circuits connecting central regions of respective diametrically opposed motor and pump cylinder pairs bounded by corresponding first and second pistons of respective piston assemblies, whereby axial displacement of one of the piston assemblies effects a corresponding axial displacement of a diametrically opposed piston assembly in the opposite direction.

10. A pump according to claim 9, including four peripherally spaced motor and pump cylinder pairs, each connected to a diametrically opposed pair by means of an independent hydraulic fluid circuit.

11. A pump according to claim 1 wherein each piston includes a stepped shoulder portion nestingly engageable with a corresponding generally frusto-conical tapered end socket, thereby defining a progressively reducing generally annular cross sectional flow area as the piston approach their respective limits of axial excursion, to provide an degree of hydraulic piston damping.

12. A pump according to claim 1, further including hydrostatic thrust bearings associated with the motor or pump end of the barrel, to provide self-adjusting hydraulic control of axial clearance between opposing valve surfaces, whereby hydraulic thrust pressure on the barrel tends to maintain valve clearances within predetermined limits.

13. A pump according to claim 1 wherein the respective corners of the inlet and discharge ports are rounded, thereby to minimise the formation of circumferential roll grooves in opposing valve faces associated with the barrel.

14. A positive displacement pump for slurry incorporating particulate solids in suspension, said pump including:

a housing;

a barrel rotatably mounted within the housing and including a plurality of peripherally spaced motor cylinders and a corresponding number of pump cylinders in respective coaxial alignment with said motor cylinders forming a peripheral array of generally longitudinally extending spaced apart motor and pump cylinder pairs;

a plurality of double acting piston assemblies each comprising a first piston disposed within a respective motor cylinder and a second piston interconnected with and spaced apart from said first piston and disposed within a corresponding pump cylinder, said piston assemblies being sealingly and slideably mounted for reciprocation within the respective motor and pump cylinder pairs;

interconnecting means associated with said motor and pump cylinder pairs whereby axial displacement of any one of said piston assemblies effects a corresponding axial displacement of another of said piston assemblies in predetermined phase relationship;

a stationary motor port block fixed with respect to said housing and including a driving fluid supply port and a driving fluid exhaust port disposed respectively to overlap periodically with corresponding openings in said motor cylinders whereby driving fluid under pressure is alternately admitted into successive motor cylinders through said supply port and discharged through said exhaust port in response to rotational movement of said barrel within said housing thereby to effect a corresponding phase related reciprocating movement of said piston assemblies;

a stationary pump port block fixed with respect to said housing and including an inlet port and a discharge port disposed respectively to overlap periodically with corresponding openings in said pump cylinders whereby fluid to be pumped is alternately admitted into successive pump cylinders through said inlet port as the respective piston assemblies are withdrawn during a suction cycle, and subsequently discharged under pressure through said discharge port as the respective pistons are advanced during a pumping cycle in response to the rotational movement of the barrel;

said inlet port being configured so as to initially overlap with each corresponding opening in said pump cylinders before the respective pistons associated with those cylinders begin to withdraw, thereby to provide an initial inlet port opening clearance corresponding to the exposed area of overlap between said port and each said corresponding cylinder opening sufficient to permit substantially uninterrupted passage of said particulate solids at the commencement of each said suction cycle;

said cylinder openings and said ports being disposed such that following said initial overlap the total cross sectional flow area exposed to each of said ports is generally constant irrespective of the rotational position of said barrel within said housing such that a constant volumetric flow rate of said driving fluid tends to effect a corresponding substantially constant volumetric flow rate of said fluid to be pumped; and a pressure monitoring system comprising pressure transducing means to monitor pressure fluctuations within the pump and position transducing means to monitor the positions of the pistons within their respective cylinders, said transducing means forming part of a control system adapted automatically to adjust pump speed in response to vibration levels.

* * * * *

UNITED STATES PATENT AND TRADEMARK OFFICE

CERTIFICATE OF CORRECTION

PATENT NO. : 5,316,451

DATED : May 31, 1994

INVENTOR(S) : Donald G. Hore, deceased, et al

It is certified that error appears in the above-indentified patent and that said Letters Patent is hereby corrected as shown below:

Column 1, line 49, "pumps" should be --pump--.

Column 3, line 23 after "D-50" insert --size--.

Column 5, line 20 after "below" insert --.--.

Column 5, line 54 "form" should be --from--.

Column 6, line 40 "and" should be --end--.

Column 7, line 11 "Unexpectively" should be --Unexpectedly--.

Column 7, line 38 "8" should be --9--.

Column 7, line 44 "particularly" should be --particular--.

Column 8, line 17 "system" should be --systems--

Column 8, line 56 "position" should be --positions--.

Column 9, line 45 "embodies" should be --embodied--.

Column 11, line 3, Claim 11, line 6 "piston" should be --pistons--.

UNITED STATES PATENT AND TRADEMARK OFFICE

CERTIFICATE OF CORRECTION

PATENT NO. : 5,316,451 Page 2 of 2

DATED : May 31, 1994

INVENTOR(S) : Donald G. Hore, deceased, et al

It is certified that error appears in the above-indentified patent and that said Letters Patent is hereby corrected as shown below:

Column 11, line 9, Claim 12, line 4 "clearance" should be --clearances--.

Signed and Sealed this

Eighteenth Day of October, 1994

*Attest:*

*Attesting Officer*

BRUCE LEHMAN

*Commissioner of Patents and Trademarks*